United States Patent [19]

Donovan

[11] Patent Number: 4,588,635

[45] Date of Patent: May 13, 1986

[54] SYNTHETIC DOWN

[75] Inventor: James G. Donovan, Norwell, Mass.

[73] Assignee: Albany International Corp., Albany, N.Y.

[21] Appl. No.: 780,384

[22] Filed: Sep. 26, 1985

[51] Int. Cl.[4] ..... D04H 1/58

[52] U.S. Cl. ..... 428/288; 428/297; 428/299; 428/903; 428/920

[58] Field of Search ..... 428/288, 297, 299, 903, 428/920

[56] References Cited

U.S. PATENT DOCUMENTS

T100,902 8/1981 Hauser ..... 428/903
3,016,599 1/1962 Perry ..... 428/903
4,364,996 12/1982 Sugeyama ..... 428/6
4,418,103 11/1983 Toni et al. ..... 428/4

*Primary Examiner*—James J. Bell
*Attorney, Agent, or Firm*—Kane, Dalsimer, Kane, Sullivan and Kurucz

[57] ABSTRACT

A synthetic replacement for down is described which comprises a blend of (a) 80 to 95 weight percent of synthetic, spun and drawn, crimped, staple, polyester microfibers having a diameter of from 3 to 12 microns; and (b) 5 to 20 weight percent of synthetic, thermoplastic, staple macrofibers having a diameter of from more than 12, up to 50 microns.

9 Claims, 2 Drawing Figures

SYNTHETIC DOWN

BACKGROUND OF THE INVENTION

The U.S. Government has rights in this invention pursuant to contract DAAK60-83-C-0022 awarded by the Department of the Army.

1. Field of the Invention

The invention relates to a synthetic thermal insulator made of fibrous components and more particularly relates to such a material which is a replacement for down.

2. Brief Description of the Prior Art

Representative of the prior art are disclosures given in the U.S. Pat. Nos. 3,892,909; 4,042,740; 4,118,531, 4,134,167; 4,167,604; 4,364,996; 4,418,103; and U.K. Patent Application No. 2,050,818A.

The superiority of down as a lightweight clothing and bedding insulator has been recognized for centuries. In spite of several recent and very worthwhile advances in synthetic insulation, down has retained its status as the ultimate, lightweight insulator. Its insulating efficiency has not yet been equalled by a commercially-available product with the minimal density of a typical down filling. The loftiness that characterizes down and makes it such an efficient thermal barrier is unique in a further sense; it is recovered almost completely when a compressed down assembly is agitated. The loft-related virtues of down exist only under dry conditions, however, and loss of loft and an accompanying deterioration in thermal performance when wet is the primary shortcoming of down in field applications.

I have discovered that a very particular blend of microfibers and macrofibers produces a synthetic alternative to down. The blend of the invention compares favorably to down or mixtures of down with feathers as an insulator in that it will:

a. Provide an equally efficient thermal barrier,
b. Be of equivalent density,
c. Possess similar compressional properties,
d. Have improved wetting and drying characteristics, and
e. Have superior loft retention while wet.

Background information relating to some of these performance characteristics is given below.

Down sleeping bags and garments are extremely efficient thermal insulators because they have a very low internal heat transfer coefficient at all bulk densities when compared to the alternative materials presently employed. Moreover, experimental data also shows that the relative advantage of down becomes greater at the very low bulk densities at which it is generally used. In the literature it is common practice to compare the thermal performance of materials in terms of an 'apparent or effective thermal conductivity'. However it is extremely important to realize that for fibrous insulating materials at the bulk densities that are of interest in personal cold-weather protection applications, the heat transfer is as much due to radiation and convection as it is to conduction in the fibers and the air. Consequently, improvements (decreases) in heat transfer by any of the three mechanisms of conduction, radiation and convection can potentially lead to performance improvements, and the present invention pays particular attention to the radiation component of the heat transfer, and takes advantage of a previously unappreciated characteristic of radiative transfer.

In practice the balance between the three heat transport modes depends on the test or usage conditions as well as the sample structure and configuration. For instance, when we measure the 'apparent' thermal conductivities of various webs at a certain temperature gradient and mean temperature ($\Delta T=50°$ F., $t_m=75°$ F. were selected as standard in our case) we have to remember that the results depend on the direction of heat flow. It is known that heat flow 'down' tests eliminate convection, so most samples were evaluated in this configuration. This simplifies the interpretation of the experimental data since only two modes of heat transfer, namely conduction and radiation are operative, and moreover since the conductive component is readily calculable for assemblies of these densities the critical role of radiation is easy to demonstrate.

Heat transfer by thermal conduction in a low density fibrous web occurs by conduction across the air gaps and by conduction through and between fibers. The conduction can be treated theoretically as taking place in a two-phase mixture of air and fibers - the air being the matrix and the fibers the included component. The standard mixture laws for two-phase systems apply and the overall conductivity $k_C$ is given by $$k_C=f(k_a,k_f,V_F)$$

where $k_a$ and $k_f$ are the conductivities of the air and solid fiber and $V_F$ is the volume fraction of fiber in the web assembly, such that $$V_F=P_F/P_f$$

and $P_F$ and $P_f$ are the web and fiber material densities.

The form of the appropriate mixture law depends upon the geometry of the system and many attempts have been made to derive generalized representations of the functionality expressed by the expression of $K_C$ above. Examination of these results shows that the general form for low density assemblies is $$k_C \approx k_a+\Gamma V_F$$

where $\Gamma$ is a function of the geometry and $k_a<\Gamma<k_f$. When $V_F$ is very small ($\sim 0.01$), then a good approximation (within 2%) is simply $$k_C \approx k_a$$

and this approximation is generally adequate over the range of densities that is of interest in the applications considered here. Thus it is possible to conclude that the heat transfer by conduction is essentially controlled by the conductivity of air, $k_a$, and this can not be reduced unless some form of evacuated system is used. Hence in order to reduce the heat transfer it is necessary to manipulate the radiation and natural convection conductivities. Since the test methodology used is such that the convective component is suppressed, it is sufficient to focus attention on the radiative component.

We have seen that if the only (or the main) heat transfer mechanism in low density fiber batts or webs was by heat conduction, we would expect the 'conductivity' to be constant—or to increase slightly with increased density. This is not found to be the case, however, as shown by the experimental data of Finck[1], Baxter[2], Fournier and Klarsfeld[3], and Farnworth[4] for various materials and by Rees[5] for down. In fact, if the 'conductivity' is measured for the same material over a range of decreasing densities, it is seen that the conductivity decreases to a minimum and then the conductivity increases as density decreases, at a faster and faster rate.

[1] Finck, J. L., "Mechanisms of Heat Flow in Fibrous Materials", J. N. B. S., 1930
[2] Baxter, S., "The Thermal Conductivity of Textiles", Proc. Physics Soc., 1946
[3] Fournier, D. and Klarsfeld, S., "Some Recent Experimental Data on Glass Fiber Insulting Materials, etc.", ASTM STP 544, 1974
[4] Farnworth, B., "Mechanisms of Heat Flow Through Clothing Insulation", TRJ, 12, 1983
[5] Rees, W. M., Shirley Institute Conference on Comfort, 1978

The large conductivity at low densities is due to radiation if the heat flow direction is downwards or to radiation and natural convection when the heat flow direction is upwards. Experimental data for down at a range of densities measured with the heat flow down is shown in FIG. 1, and since there is no convective component the increase in heat transfer at low densities is clearly attributable to radiation. The direct plot of effective thermal conductivity as a function of density $P_F$ does not permit ready comparisons between materials since it is not easy to estimate relevant characterizing parameters from a curvilinear plot. However, it is found that a plot of the product $kP_F$ against $P_F$ for low density fiber assemblies gives a straight line with a slope equal to the conductivity of air, $k_a$, and the intercept of this plot on the $kP_F$ axis permits a quantification of the radiative heat transfer. This intercept, C, with units of (Btu in/hr ft$^2$ °F.) (lb/ft$^3$) in the British system is called the radiation parameter, and in order to produce the lowest possible heat transfer through a fiber assembly, this radiative parameter should be reduced to its minimum value.

Table I gives measured values of this parameter for a wide range of polymeric fiber assemblies, together with details of the test materials, and FIG. 2 shows a plot of the radiation parameter against fiber diameter. The general tendency that is clear from the experimental results is that the radiative parameter is reduced as the fiber diameter is decreased, with the result that the effective thermal resistance of the assembly is increased. It is equally clear, however, that this reduction in fiber diameter is not beneficial without limit, since the samples of fiber assemblies containing microfibers show a sharp increase in radiation parameter. One of these assemblies is a commercial manifestation of the material described by Hauser (U.S. Pat. No. 4,118,531) and Hauser's unequivocal statement (col. 4, line 24) that "The finer the microfibers in a web of the invention the better the thermal resistance" is demonstrably untrue. It is interesting and significant that down, in which the fine fiber component has a diameter range of 2.5 to 11.0 microns, appears to be situated at the minimum of the curve relating the radiation parameter to fiber diameter, and any synthetic polymeric fiber assembly attempting to emulate the thermal properties of down must also be so situated. One of the surprising and novel aspects of the present invention is that it is demonstrated that this will not be possible if the fiber assembly contains a significant proportion of very fine fibers (here defined as having diameters smaller than 3 microns), and since the slope of the curve is extremely steep on the small diameter side of the minimum, then only a small fraction of very fine fiber is sufficient to compromise the low value of the radiation parameter. In order to maintain a minimal value of the radiation parameter it is desirable that the fiber assembly contain no more than 5% of fiber material with a diameter smaller than 3 microns.

TABLE I

Values of the Radiation Parameter C

| | Density $P_f$ | Denier | Diameter d(μ) | Radiation Parameter, C $\frac{\text{Btu-in}}{\text{hr ft}^2\ °\text{F.}} \times \frac{\text{lb}}{\text{ft}^3} \times 10^2$ |
|---|---|---|---|---|
| Down | 1.30 | — | 2.5–11.0 | 5.92 |
| Albany Res. Co. PET | 1.38 | 0.5 | 7.5 | 5.92 |
| Teijin PET | 1.38 | 0.8 | 10 | 6.50 |
| DuPont D102 PET | 1.38 | 1.6 | 13 | 7.32 |
| Celanese Polarguard PET | 1.38 | 5 | 23 | 10.10 |
| Hollofil 808 PET | 1.17 | 5.5 | 26 | 11.85 |
| Hollofil II PET | 1.17 | 5.5 | 26 | 12.77 |
| Hollofil 91 PET | 1.17 | 15 | 42 | 15.56 |
| Melt-blown polyolefin | 0.90 | — | 1–3 | 14.25 |
| Melt-blown PET | 1.38 | — | 1–3 | 7.55 |
| Hollofil II ($\epsilon_o = \epsilon_L = .05$) | 1.17 | 5.5 | 26 | 10.10 |
| Kevlar 49 | 1.4 | 1.4 | 12 | 9.16 |
| Black PET | 1.38 | 4.5 | 21 | 15.10 |

Examination of FIG. 2 allows reasonable estimates of the upper levels of fiber diameter permissible if the thermal properties of the assembly are to be maintained. It we set a limit of 0.075 units (Btu in/hr ft$^2$ °F.) (lb/ft$^3$) for the radiation parameter, then the plot indicates that the bulk of the fibers must lie within the diameter range of 3.0 to 12.0 microns and measurement of the thermal conductivity of a number of webs confirms this conclusion.

The discussion presented above dealt with the physical parameters that control the thermal properties of low-density fiber assemblies; in order to produce a satisfactory down substitute material it is necessary also to examine the mechanical behavior of such an assembly, and attempt to determine the optimum configuration for the assembly. This relates not only to the ability of the assembly to maintain its preferred geometrical form but also gives some indication of the degree of difficulty that might be encountered in establishing the assembly during the manufacturing process. Measurements of the thermal behavior indicate that improved performance is generally associated with small diameter fibers, but that there is a lower limit of about 3 microns below which the thermal performance begins to deteriorate significantly. From a mechanical standpoint it is a matter of experience that extremely fine fibers suffer from deficiencies of rigidity and strength that make them difficult to produce, manipulate and use, and there is therefore a minimum fiber diameter below which efforts to realize improved performance are not worthwhile. It is generally acknowledged that very fine fibers produce assemblies that exhibit very poor recovery from compressive deformation. All the currently-available commercial webs made from microdenier fibers exist only as dense structures, since they fall within the practical limits set by the fiber rigidity and are continuously subjected to consolidating forces throughout their use-life. It is interesting that this behavior is in marked contrast to that of down, which is renowned for the renewable nature of its loft. It is likely that the unusual behavior of the down is related primarily to the system of nodes that exist on the fibrillae, which lead to a predisposition of a low density configuration under certain circumstances. The recovery behavior is probably also aided by the presence of the small fraction of large diameter, stiffer filamentary material in the down assembly. Whatever the reason for the lofting potential of down, the maintenance of a low density is extremely important to the concept of lightweight warmth and is an essential feature of any viable down substitute material.

The problems associated with the mechanical stability of fine fiber assemblies are exacerbated in the wet condition since the surface tension forces associated with the presence of capillary water are considerably greater than those due to gravitational forces or other normal use loading and they have a much more deleterious effect on the structure. A simple calculation suggests that the residual deformation in a wet assembly is likely to be at least one order of magnitude more severe than for a dry assembly due to gravitational loading even under the best conditions. This calculation illustrates dramatically the extreme vulnerability to collapse of fine fibrous assemblies under capillary forces. Moreover the estimate unquestionably underestimates the situation since the Young's modulus of polymeric materials can typically be reduced by at least one order of magnitude when wet, which will further increase the seriousness of the effect. Under wet conditions, analysis suggests that an assembly made of filaments with diameters below 10 microns could be extremely vulnerable to collapse under saturating conditions and experimental evidence fully confirms this expectation both for down and for synthetic polymer assemblies. It is highly desirable to have the filaments made from a polymer such as polyester, polyolefin or polyaramid whose mechanical properties are not significantly reduced on wetting. Even if the polymer itself is insensitive to the effects of moisture it is also important to treat the fibers with a water-repellant finish. The down of commerce is usually treated in this way, and all the experimental data on down presented herein is for down so treated; similarly the synthetic polymer insulator materials described of this invention also require water repellant treatments to realize their full insulating and mechanical potential in the wet state.

The mechanical limitations of fine fiber assemblies discussed above present a serious conflict in light of the fiber diameters needed for improved thermal performance. The range of requirements, both thermal and mechanical, that the down substitute must fulfill make it almost inevitable that the assembly be made up from fibers of more than one diameter class: the small diameter fibers being responsible for the thermal performance of the assembly, with their diameter falling within the range that was discussed in the previous paragraph, namely between 3 microns and 12 microns, and the large diameter fibers being responsible for the mechanical performance of the assembly. Just as there are limits to the diameter range of the smaller active diameter component of the blend, so there are reasonable limits that can be set on the large diameter component. We consider first the length $l_f$ of filament of denier D that is contained in a unit cube of assembly of volume fraction $V_F$ and can show that an assembly of 0.01 volume fraction made up *entirely* of 1 denier fibers contains approximately $10^4$ cm of fiber. This is given by:

$$l_f = 9 \times 10^5 P_f V_F / D,$$

and this expression demonstrates that if we attempt to improve the mechanical performance of the assembly by the addition of large diameter fibers, we obviously have available a shorter length of material: for example the addition of 10% of 100 denier fiber involves only a 10 centimeter length of material. In order to be effective, this length of fiber must be distributed uniformly within the 1 cm cube in a configuration that permits good recovery from compressive loading in any direction, and such a distribution is essentially impossible to attain. Calculation indicates that the maximum fiber diameter that can be tolerated as a recovery modifier in a low density assembly is approximately 30 denier, and smaller denier materials would be preferred for minimum impact on the volume fraction.

The foregoing discussion addresses the issue of how much additional high denier material can be *tolerated:* it is equally important to attempt to estimate how much is *needed.* The mechanism of deformation of the high-denier component will be principally bending and torsion, and in each of these modes of deformation the flexural rigidity of a circular filament varies as the fourth power of the diameter, and the stiffness of a flexural or torsional beam varies inversely as the third power of the length of the element. The deformation stiffness S of the assembly can be written $$S \alpha EI/l^3$$

where l is the free length of fiber between contact points. Since $I \alpha d^4$ and $l \alpha d/V_F$ it is possible to write:

$$S \infty d V_F^3.$$

This expression shows the extreme sensitivity of the stiffness of the assembly to the volume fraction, and the relative insensitivity to the fiber diameter, since the geometrical parameters of the assembly geometry offset the large changes in filament properties. This suggests that the use of high denier fibers is particularly valuable in very low density assemblies. The combined analysis suggests that the larger fiber in a low density mixed assembly should ideally have a diameter of approximately 50 microns in order to maximize the mechanical performance at a given density, and that a 10% weight of mixture should be adequate.

SUMMARY OF THE INVENTION

The invention comprises a thermal insulation material, which comprises a blend of (a) 80 to 95 weight percent of spun and drawn, crimped, staple, synthetic polymeric microfibers having a diameter of from 3 to 12 microns; and (b) 5 to 20 weight percent of synthetic polymeric staple macrofibers having a diameter of from more than 12, up to 50 microns.

The insulation material of the invention is useful as a replacement for down and down/feather mixtures in clothing, bedding and like articles of insulation.

DETAILED DESCRIPTION OF THE PREFERRED EMBODIMENTS OF THE INVENTION

Figure 1:
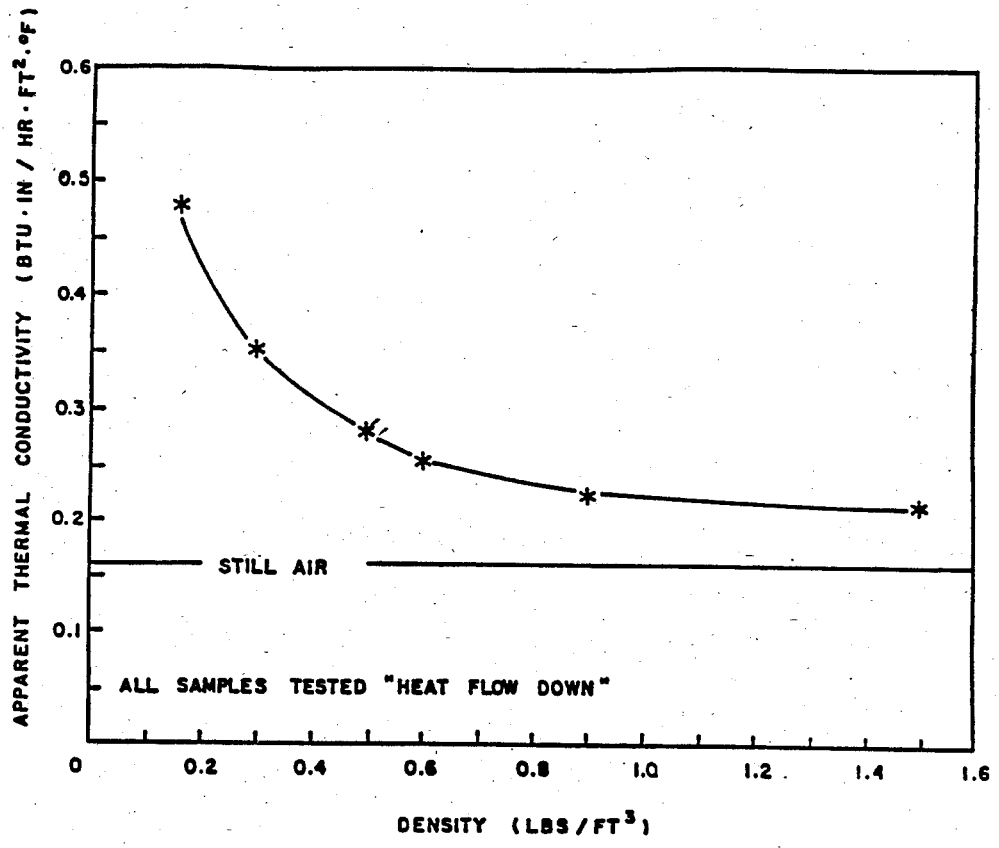
FIG. 1 is a graph plotting the effective thermal conductivity as a function of density for down insulation.

The thermal insulation material of the invention comprises a blend of two different textile fibers. The fibers differ, essentially, in their diameters. The majority of the fibers in the blend are microfibers, with a diameter within the range of from 3 to 12 microns. The minor proportion of the blend is made up with macrofibers, i.e., fibers having a diameter of more than 12 microns, up to about 50 microns.

The microfibers employed in preparing the blended materials of the preferred form of the invention are spun and drawn microfibers of a polyester, preferably of polyethylene terephthalate, though other polymeric materials may also be used in this invention. Methods of their manufacture are well known; see for example U.S. Pat. No. 4,148,103. Advantageously the microfibers are drawn following their extrusion, to achieve a high tensile modulus, which is about 70 to 90 gms/denier in the present example. A relatively high tensile modulus contributes to a high bending modulus in the material of the invention, and helps with the mechanical performance.

Advantageously, the macrofibers are also spun and drawn fibers of a synthetic polymeric resin such as a polyester (preferably polyethylene terephthalate). We have also found macrofibers of polyaramids such as poly(p-phenylene terephthalamide) to be advantageous. Macrofibers of poly(p-phenylene terephthalamine) are commercially available under the trademark Kevlar.

The microfibers and preferably the macrofibers making up the thermally insulative blends of the invention are crimped fibers since this makes it possible to produce low density intimate blends of the two components. The techniques for crimping fibers are well known and process details need not be recited here. Advantageously the average crimp number for both the microfibers and the macrofibers is within the range of from 8 to 20 crimps per inch. It is possible to achieve satisfactory results with uncrimped macrofibers but I believe that the presence of crimp on the microfiber component is critical to the successful operation of a low density, lofty assembly. The presence of individualized opened and crimped microfiber also helps to make it possible to reestablish loft in the fiber assembly after compression or wetting, and hence improve the long term utility of the invention.

The microfibers and the macrofibers employed in the blends of the invention may, optionally, be lubricated. Representative of lubricants conventionally used are aqueous solutions of organopolysiloxanes, emulsions of polytetrafluoroethylene, non-ionic surfactants and the like. Such lubricants may be applied to the fibers by spray or dip techniques well known in the art.

The macrofibers and the microfibers are blended together to form batts consisting of plied card-laps, although other fibrous forms may be equally suitable. The card-laps, or output webs from a carding machine, are intimate blends of spun-and-drawn microfibers and macrofibers. The batts are advantageously made to achieve densities comparable to the densities characteristic of down, i.e., on the order of less than 1.0 lb/cubic foot, typically around 0.5 lb/cubic foot.

The following examples describe the manner and process of making and using the invention and set forth the best mode contemplated by the inventor for carrying out the invention but are not to be construed as limiting. Where reported, the following tests were employed:

Density: The volume of each insulator sample was determined by fixing two planar sample dimensions and then measuring thickness at 0.002 lb/in.$^2$ pressure. The mass of each sample divided by the volume thus obtained is the basis for density values reported herein.

Thickness was measured at 0.002 lb/in.$^2$.

Apparent thermal conductivity was measured in accord with the plate/sample/plate method described by ASTM Method C518.

Compressional Strain: Strain at 5 lb/in.$^2$, which was the maximum strain in the compressional recovery test sequence, was recorded for each test.

Compressional Recovery and Work of Compression and Recovery: Section 4.3.2 of Military Specification MIL-B-41826E describes a compressional-recovery test technique for fibrous batting that was adapted for this work. The essential difference between the Military Specification method and the one employed is the lower pressure at which initial thickness and recovered-to-thickness were measured. The measuring pressure in the specification is 0.01 lb/in.$^2$, whereas 0.002 lb/in.$^2$ was used in this work.

Water Absorption Capacity: ASTM Method D1117 provided the starting point for development of the water absorption- capacity and absorption-time test used. However, wetted- sample weighings were made at frequent intervals during the first six hours of immersion and another weighing was made after twenty-four hours (Method D1117 requires only one wetted sample weighing). A unique sample-holder and a repeatable technique for draining excess water prior to each weighing were adopted after some initial experimentation.

Drying Time: After each absorption capacity test, weighings were made at one-half hour intervals as the sample air-dried on a wire rack in a 70° F., 65% r.h. atmosphere.

The down used throughout the examples was actually a down/feathers mixture, 80/20 by weight, per MIL-F-43097G, Type II, Class I. This mixture is commonly and commercially referred to as "down" and is often referred to as "down" herein.

EXAMPLE 1

A quantity of spun and drawn 1.2 inch long microfibers having a diameter of 7.5 microns is provided. The fibers are lubricated with a silicone finish. The spun-and-drawn microfibers are polyester and have been drawn to achieve a relatively high tensile modulus (60–90 grams/denier), which contributes significantly to a high bending modulus. After drawing they have been crimped, cut into staple and thoroughly opened, or separated, in a card. The high bending stiffness and crimp are essential characteristics which provide and help to maintain advantageous loft. The average crimp frequency is 14/inch and the average crimp amplitude is 0.04 inches. Loft and compressional characteristics are improved further through the blending with 10 percent by weight of macrofibers of the same polyester (polyethylene terephthalate) having diameters of 25.5 microns. The macrofibers are lubricated with a silicone finish and are characterized in part by a staple length of 2.2 inches, an average crimp frequency of 8.5/inch and a crimp amplitude (average) of 0.06 inches. The blend is carded into a batt. The physical properties of the batt are shown in *Table II,* below, compared to a batt of down:

EXAMPLE 2

The procedure of *Example* 1, *supra.,* is repeated except that the macrofiber as used therein is replaced with 20 percent by weight of uncrimped poly(p-phenylene terephthalamide) fibers having a diameter of 12 microns, a length of 3.0 inches, and a silicone lubricant finish. The physical characteristics of the material formed are given in *Table II* below.

TABLE II

| | Down | Example 1 | Example 2 |
|---|---|---|---|
| Apparent thermal conductivity (Btu-in./hr-ft$^2$-°F.)[a] | 0.280 | 0.281 | 0.271 |
| Thermal cond. test density (lb/ft$^3$) | 0.45 | 0.47 | 0.48 |
| Minimum density (lb/ft$^3$) | 0.24 | 0.25 | 0.25 |
| Comp. strain at 5 lb/in.$^2$ (%)[b] | 95 | 96 | 92 |
| Comp. recovery from 5 lb/in.$^2$ (%)[b] | 102 | 112 | 112 |
| Work to compress to 5 lb/in.$^2$ (lb-in.) | 4.91 | 3.49 | 3.57 |
| Resilience[c] | 0.53 | 0.62 | 0.60 |
| Wetting during Immersion | | | |
| Water absorption after 20 min. (× dw)[d] | 1.16 | 2.16 | 1.41 |
| Density after 20 min wetting wetting (lb/ft$^2$) | 0.48 | 0.50 | 0.51 |
| Water absorption after 6 hr (× dw) | 3.75 | 5.15 | 3.44 |
| Density after 6 hr wetting (lb/ft$^3$) | 3.55 | 0.94 | 1.02 |
| Drying after 24 hrs. Water Immersion | | | |
| Weight after 30 min drying (× dw) | 3.88 | 4.83 | 3.29 |
| Density after 30 min drying (lb/ft$^3$) | 5.20 | 0.95 | 0.90 |
| Weight after 6 hr drying (× dw) | 2.45 | 1.68 | 1.01 |
| Density after 6 hr drying (lb/ft$^3$) | 3.20 | 0.41 | 0.44 |

[a]Heat flow down: 2.06 inch specimen thickness.
[b]Gauge length: 2.00 inches; density at 2.00 inch thickness was 0.50 lb/ft$^3$.
[c]Resilience equals: work-of-recovery divided by work-to-compress.
[d]× dw: times dry-weight It can be seem from the above Table II that, in most instances, both examples of the invention offer performance equivalent to that of the down/feathers mixture, and that the values of compressional recovery, work to compress, and resilience measured for both embodiments represent some improvement over those of down. Improvement of perhaps greater significance is apparent through comparison of densities at the "6 hr wetting," "30 min drying" and "6 hr drying" intervals in the wetting/drying cycle. The much lower densities measured for the two forms of the invention show that it retains its loft while wet and, most probably its insulating value, to a far greater degree than does down. Resistance-to-wetting and resistance to loss-of-loft while wet are inherent advantages of the fiber combination described. The hydrophobic nature of polyester and the microporous structure of the insulators are assumed to contribute to these desirable characteristics.

What is claimed:

1. A synthetic fiber batt thermal insulator material, which comprises a blend of (a) 80 to 95 weight percent of spun and drawn, crimped, staple synthetic polymeric microfibers having a diameter of from 3 to 12 microns; and (b) 5 to 20 weight percent of synthetic polymeric staple macrofibers having a diameter of from more than 12, up to 50 microns, said batt having the following characteristics:

a radiation parameter defined as the intercept on the ordinate axis at zero density of a plot of $k_C P_F$ against $P_F$ less than 0.075 (Btu-in/hr-ft$^2$-°F.) (lb/ft$^3$)

a density $P_F$ from 0.2 to 0.6 lb/cu ft and an apparent thermal conductivity $K_C$ measured by the plate-to-plate method according to ASTM C518 with heat flow down of less than 0.5 Btu-in./hr ft$^2$°F.

2. The material of claim 1 having in the dry state a compressive strain of at least 90% under a compressive stress of 5 lbs/square inch and a long-term compressive recovery of at least 95% after removal of this stress.

3. The material of claim 1 in which at least one of the fibrous components is treated with a water repellant finish.

4. The material of claim 1 in which at least one of the fibrous components is treated with a lubricant finish.

5. The material of claim 1 in which the crimp in the microfibers is within the range 8 to 20 crimps per inch.

6. The materials of claim 1 in which the synthetic polymeric fibers are poly(ethylene terephthalate).

7. The material of claim 1 in which the synthetic polymeric fibers are polyaramide such as poly(p-phenylene terephthalamide).

8. The material of claim 1 in which the microfiber component is a polyolefin.

9. The material of claim 1 in which the macrofibers are crimped.

* * * * *

UNITED STATES PATENT AND TRADEMARK OFFICE

CERTIFICATE OF CORRECTION

PATENT NO. : 4,588,635

DATED : May 13, 1986

INVENTOR(S) : JAMES G. DONOVAN

Figure 2:
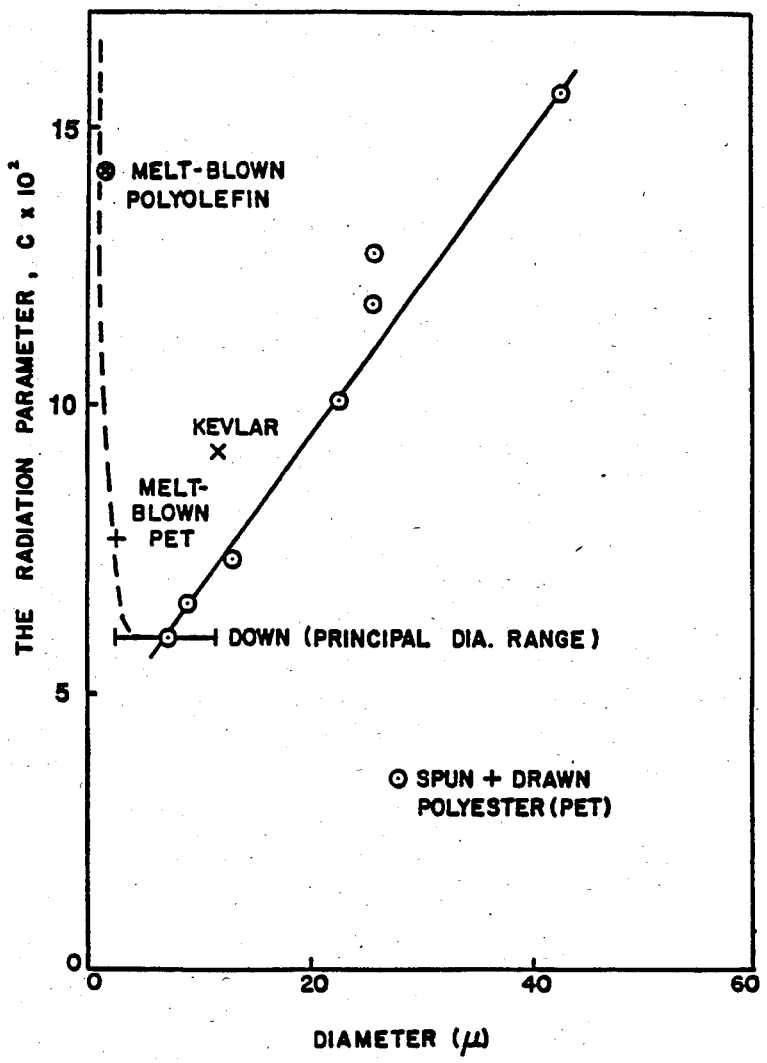
FIG. 2 is a graphical representation plotting the radiation parameter against fiber diameter for a number of different fibers.

It is certified that error appears in the above-identified patent and that said Letters Patent is hereby corrected as shown below:

Figure 2 should be deleted and the following graph should be substituted therefor:

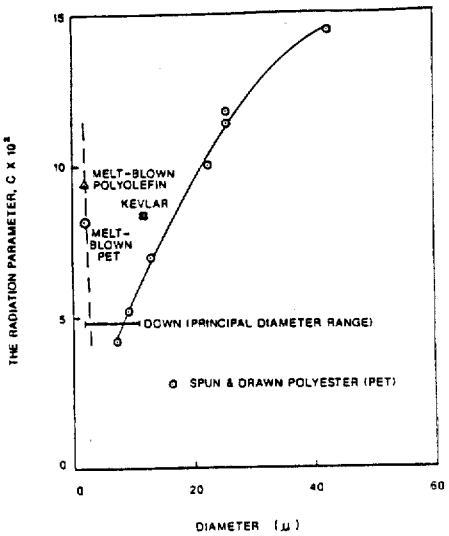

FIGURE 2

UNITED STATES PATENT AND TRADEMARK OFFICE

CERTIFICATE OF CORRECTION

PATENT NO. : 4,588,635

DATED : May 13, 1986

INVENTOR(S) : JAMES G. DONOVAN

It is certified that error appears in the above-identified patent and that said Letters Patent is hereby corrected as shown below:

Columns 3 and 4, the right-hand column in Table I should read:

— 4.8
4.2
5.2
7.0
10.1
11.8
11.4
14.5
9.4
8.1
8.7
8.4
13.0 --

Signed and Sealed this

Twelfth Day of January, 1988

*Attest:*

DONALD J. QUIGG

*Attesting Officer*

*Commissioner of Patents and Trademarks*